US006947762B1

(12) United States Patent
Kuramoto

(10) Patent No.: US 6,947,762 B1
(45) Date of Patent: Sep. 20, 2005

(54) PORTABLE TERMINAL DEVICE WITH REFLECTION BOARD

(75) Inventor: Akio Kuramoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/856,056

(22) PCT Filed: Nov. 10, 1999

(86) PCT No.: PCT/JP99/06249

§ 371 (c)(1),
(2), (4) Date: May 17, 2001

(87) PCT Pub. No.: WO00/30207

PCT Pub. Date: May 25, 2000

(30) Foreign Application Priority Data

Nov. 17, 1998 (JP) ..... 10/326838

(51) Int. Cl.[7] ..... H01Q 1/24

(52) U.S. Cl. ..... 455/550.1; 455/575.1; 455/575.7; 455/562.1; 455/347; 343/702

(58) Field of Search ..... 455/550.1, 575.1, 455/575.7, 562.1, 129, 347, 351, 12.1, 379; 343/702

(56) References Cited

U.S. PATENT DOCUMENTS

| | | | | |
|---|---|---|---|---|
| 5,940,041 A | * | 8/1999 | Koyama et al. | 343/702 |
| 5,963,853 A | * | 10/1999 | Berg et al. | 343/702 |
| 6,005,521 A | | 12/1999 | Suguro et al. | |
| 6,025,816 A | * | 2/2000 | Dent et al. | 343/895 |
| 6,150,983 A | * | 11/2000 | Massey | 343/702 |

FOREIGN PATENT DOCUMENTS

| | | |
|---|---|---|
| EP | 0 415 703 A1 | 3/1991 |
| EP | 0 895 299 A1 | 2/1999 |
| EP | 0 896 385 A1 | 2/1999 |
| JP | A 64-54407 | 3/1989 |
| JP | 8-65021 | 3/1996 |
| JP | A 8-293719 | 11/1996 |
| JP | A 9-18227 | 1/1997 |
| JP | 9-107238 | 4/1997 |
| JP | A 9-284022 | 10/1997 |
| JP | 10-135733 | 5/1998 |
| JP | 10-224134 | 8/1998 |
| WO | WO 97/40548 | 10/1997 |

OTHER PUBLICATIONS

U.S. Appl. no. 08/293,719, filed Nov. 1996, Kunito.*

The Institute of Electronics, Information and Communication Engineers, "Examination of the noise degree of helical antennas connected to satellite portable terminals (in Japanese)", Lecture proceedings distributed at the general national meeting in 1998, organized by IEICE (1998), *Tsushin 1* (Japan), IEICE, (Mar. 27, 1996), p. 195.

* cited by examiner

*Primary Examiner*—Sonny Trinh
*Assistant Examiner*—Huy Phan
(74) *Attorney, Agent, or Firm*—Young & Thompson

(57) ABSTRACT

In order to improve the reception capability of a portable terminal device while waiting for calls from a satellite, a small reflecting plate (9) in the form of a saucer is disposed below a rod-shaped satellite communication antenna (7) which is folded to hold downwardly when the portable terminal device is in the state of on-hook, waiting for calls.

13 Claims, 9 Drawing Sheets

PORTABLE TERMINAL DEVICE WITH REFLECTION BOARD

TECHNICAL FIELD

The present invention relates to a portable terminal device for use in mobile communications, especially satellite communications.

BACKGROUND ART

Portable terminal devices for mobile communications generally use a rod-shaped antenna, which is of a structure convenient for portability, such that it is folded in a device housing in a state of on-hook. Many antennas for satellite communications are in the form of a rod-shaped four-wire helical antenna. (For example, see Japanese laid-open patent publication No. 10-135733.)

A four-wire helical antenna shown in FIG. 1 of the accompanying drawings has radiation elements comprising four helical conductors 71 wound around dielectric cylinder 72 and feeder circuit 73 connected to the lower ends of the radiation elements for supplying high-frequency electric energies each having phase shifted 90 degree from neighboring ones and having the same amplitude. The four-wire helical antenna can transmit and receive a circularly polarized radio wave. Generally, the four-wire helical antenna has a cross-sectional shape as shown in FIG. 2 of the accompanying drawings. Cylinder 72 with the helical conductors wound thereon is covered with radome 81 made of a dielectric material and serving as a protective cover. Radome 81 is fixed to lower cover 82. Cover 82 houses therein feeder circuit 73 connected to the helical conductors. Feeder circuit 73 has a terminal on its lower portion which is connected via rotary joint 8 to a radio unit of a terminal device. The antenna is held upwardly when in use, and downwardly when not in use.

The four-wire helical antenna is required to have a directivity pattern for radiating a radio wave uniformly to the direction above semispherical surface of the device for use in satellite communications. FIG. 3 of the accompanying drawings shows, by way of example, a radiation pattern within an elevation angle of the four-wire helical antenna. The radiation pattern is substantially rotationally symmetric with respect to a bearing direction, and is such a pattern as to give a substantially uniform gain on the upper surface of the semispherical body.

Helical antennas also include an N-wire helical antenna having N helical conductors, other than the four-wire helical antenna. Therefore, other rod-shaped antennas can be used insofar as they can form a radiation pattern similar to the radiation pattern shown in FIG. 3, regardless of the antenna types and kinds.

The rod-shaped antenna for satellite communications which has the radiation pattern shown in FIG. 3 can be held upwardly when in use, i.e., when the terminal device is used in communications, and can be folded downwardly when not in use, i.e., when the terminal device is in the state of on-hook, waiting for calls. When the terminal device is waiting for calls with the rod-shaped antenna being folded downwardly, the sensitivity of the rod-shaped antenna with respect to radio waves traveling through the air is greatly reduced, making it difficult for the terminal device to receive a radio wave indicative of a call from the satellite. Therefore, it is necessary to hold the antenna upwardly while the terminal device is in motion when the terminal device is waiting for calls.

DISCLOSURE OF THE INVENTION

Generally, if a portable terminal device is capable of recognizing a call when it is in the state of on-hook, waiting for calls, then the antenna may be arranged its posture and adjusted the direction to start communications. If only a call needs to be recognized, then the probability of the recognition of a call is greatly increased by slightly improving reception conditions when the antenna is in the state of folded in the housing. It is an object of the present invention to provide a portable terminal device which allows a rod-shaped antenna for satellite communications to be folded in the housing and held downwardly when the portable terminal device is in the state of on-hook, waiting for calls, by improving reception conditions to receive radio waves propagating through the air with the rod-shaped antenna that is held downwardly.

To achieve the above object, a portable terminal device has a reflecting plate disposed below a rod-shaped antenna held downwardly when folded in the housing, in facing relation to the tip end of the antenna.

The rod-shaped antenna may comprise a satellite communication antenna having a directivity for radiating a uniform radio wave to the direction above a semispherical surface from the terminal.

The reflecting plate may project horizontally from a housing of the portable terminal device below the antenna.

The reflecting plate may take shape of rectangular or semicircular in top view.

The reflecting plate may have a reflecting surface made of a conductor.

The reflecting plate may have a reflecting surface comprising a linear conductor disposed on a surface of a dielectric material.

The reflecting plate may have a reflecting surface having a diameter or a side whose size is 0.1 times a wavelength in use.

The reflecting plate, which is of a small size and faces upwardly, disposed in facing relation to the stored rod-shaped antenna is effective to reflect a radio wave propagating through the air toward the antenna, blocks thermal noise from the ground, and makes easy to receive a radio wave propagating through the air while the portable terminal device is waiting for calls.

BEST MODE FOR CARRYING OUT THE INVENTION

Embodiments of the present invention will be described below with reference to the drawings.

Figure 4:
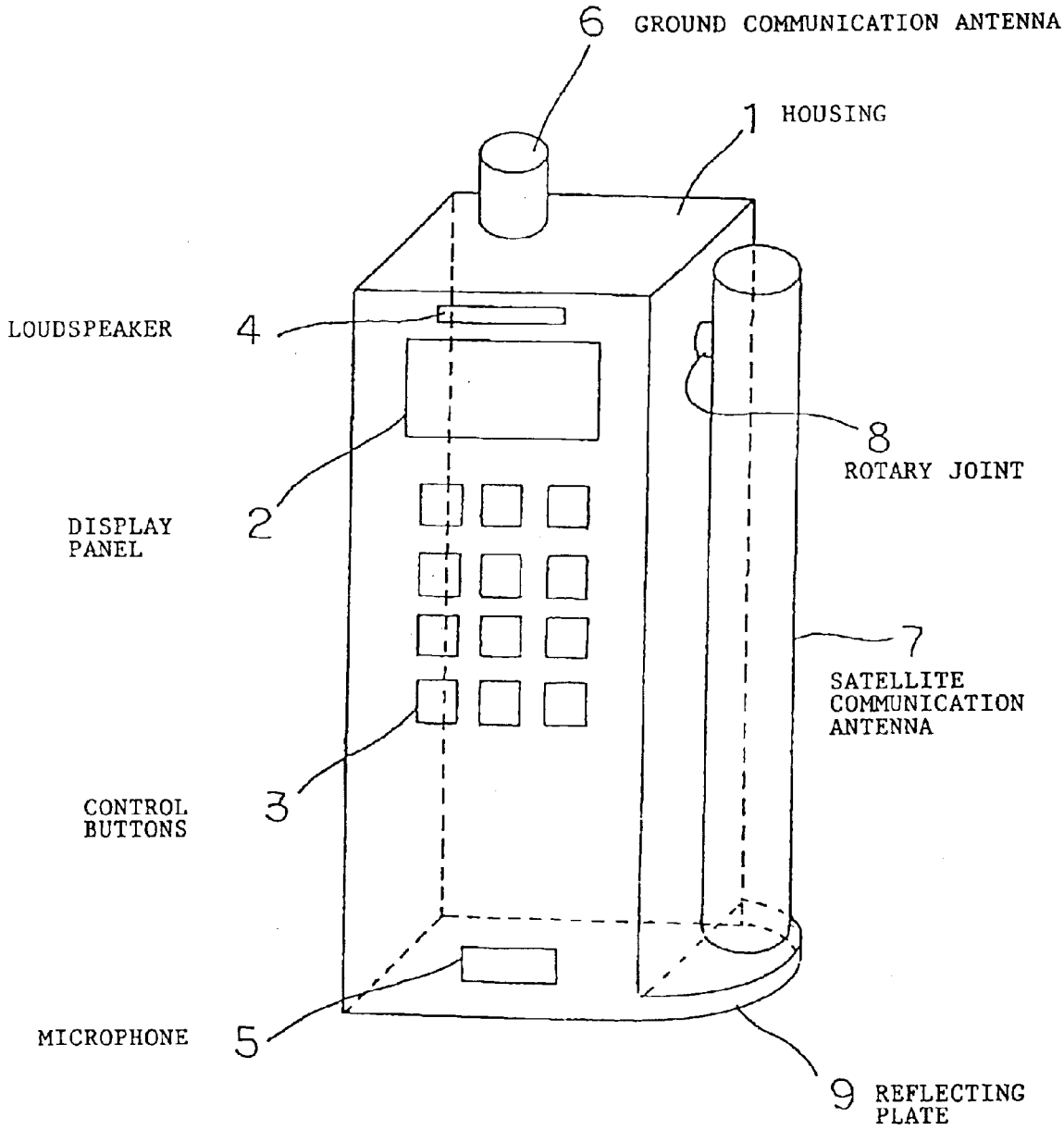
FIG. 4 is a perspective view of a portable terminal device according to an embodiment of the present invention.

FIG. 4 is a perspective view of an embodiment of the present invention. A portable terminal device shown in FIG. 4 has an antenna for a ground communication system and an antenna for a satellite communication system. The portable terminal device has a housing 1 which supports display panel 2, control buttons 3, speaker 4, microphone 5, ground communication antenna 6 for performing communications using ground radio waves, satellite communication antenna 7 for performing communications using satellite radio waves, rotary joint 8 connecting satellite communication antenna 7 to a radio unit of the portable terminal device and capable of holding satellite communication antenna 7 held at an elevation angle and folded downwardly, and reflecting plate 9.

Figure 5:
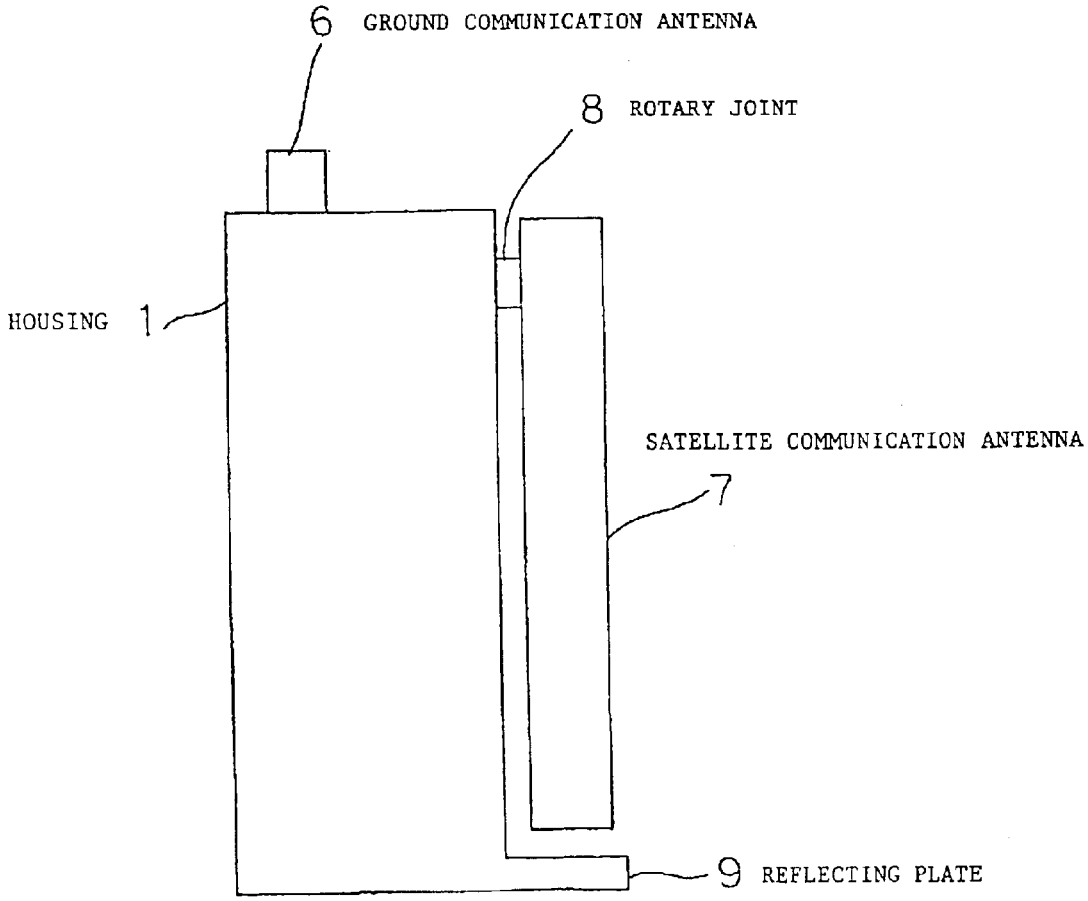
FIG. 5 is a side elevational view of the portable terminal device shown in FIG. 4, showing an antenna for satellite communications folded downwardly in a housing.

FIG. 5 is a side elevational view of the portable terminal device which is shown in perspective in FIG. 4. In FIG. 5, satellite communication antenna 7 is folded in the housing. When the portable terminal device is not used with the satellite communication system or is waiting for calls from the satellite communication system, the satellite communication antenna is held downwardly and stored as shown in FIG. 5.

Figure 6:
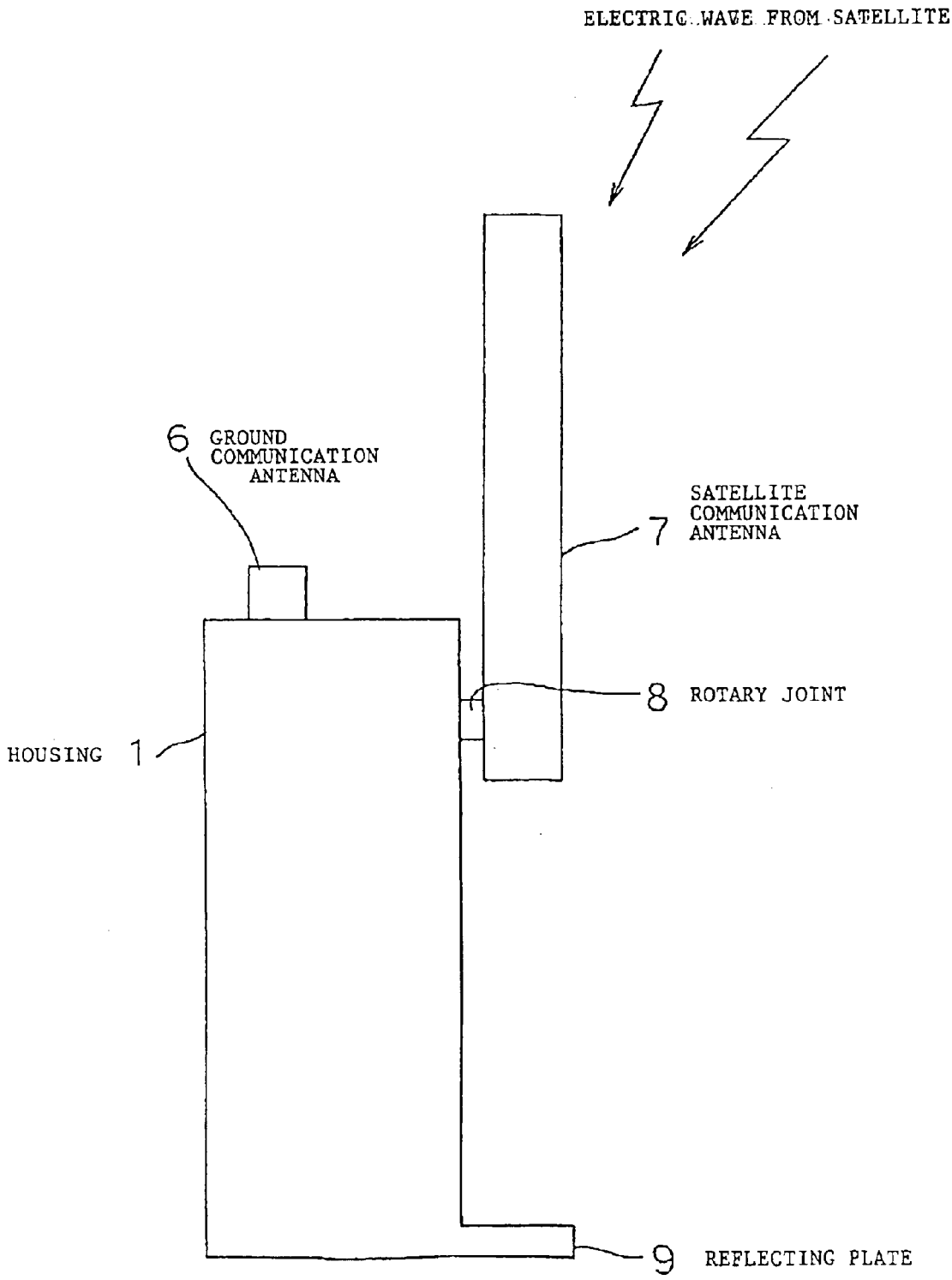
FIG. 6 is a side elevational view of the portable terminal device shown in FIG. 4, showing the antenna for satellite communications taken from the housing and held upwardly.

FIG. 6 is a side elevational view of the portable terminal device with satellite communication antenna 7 taken from the housing and directed upwardly for receiving a radio wave from the satellite with good conductivity when the portable terminal device is used for the satellite communication system.

Figure 7:
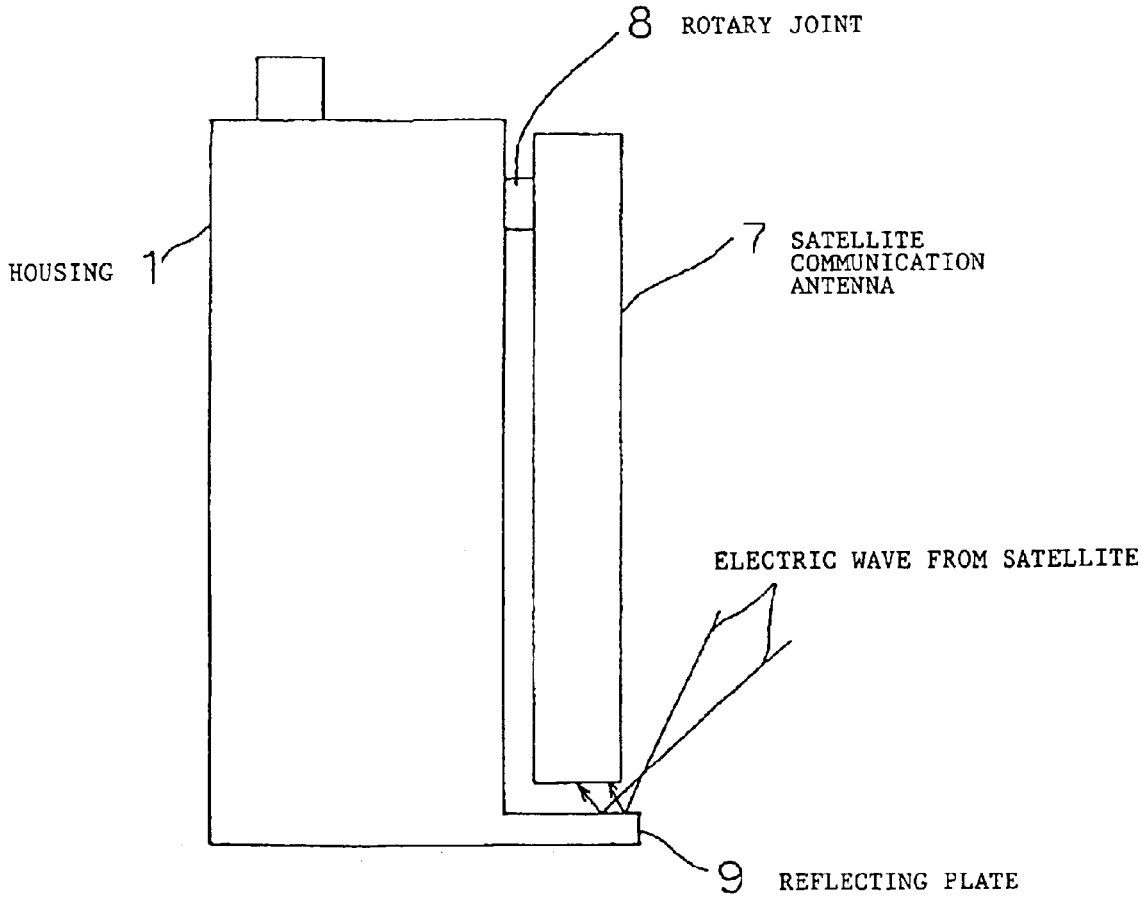
FIG. 7 is a view illustrative of the manner in which a radio wave from a satellite is reflected by a reflecting plate and applied to the antenna folded downwardly.

As shown in FIGS. 4, 5, and 6, reflecting plate 9 is attached so as to project horizontally from a lower portion of housing 1. Reflecting plate 9 faces the antenna when satellite communication antenna 7 is folded downwardly. At this time, the radio wave from the satellite is reflected toward the antenna, as shown in FIG. 7, and hence can easily be received.

Figure 1:
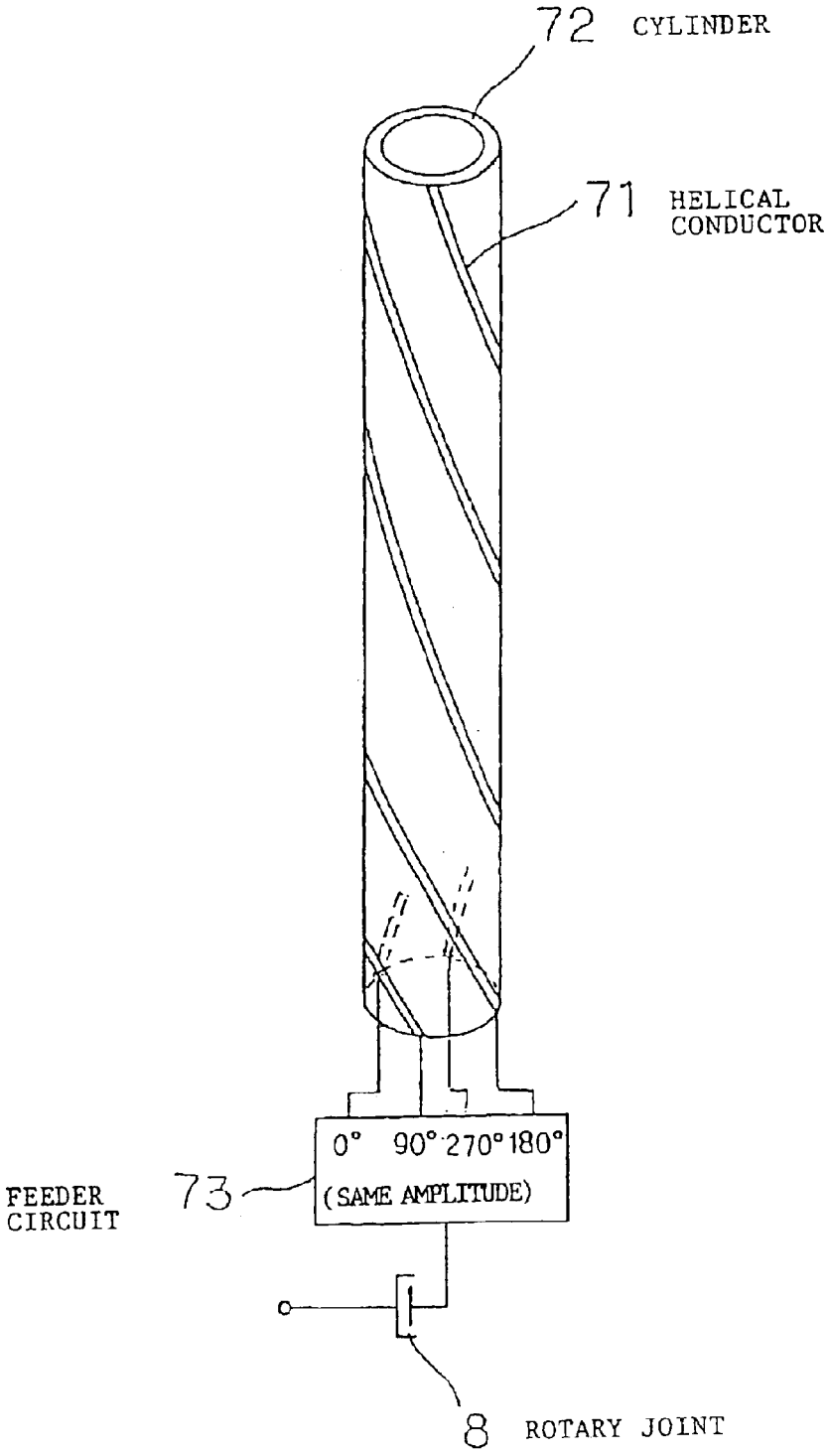
Fig. 1 (PRIOR ART)
FIG. 1 is a view of a four-wire helical antenna.
Figure 2:
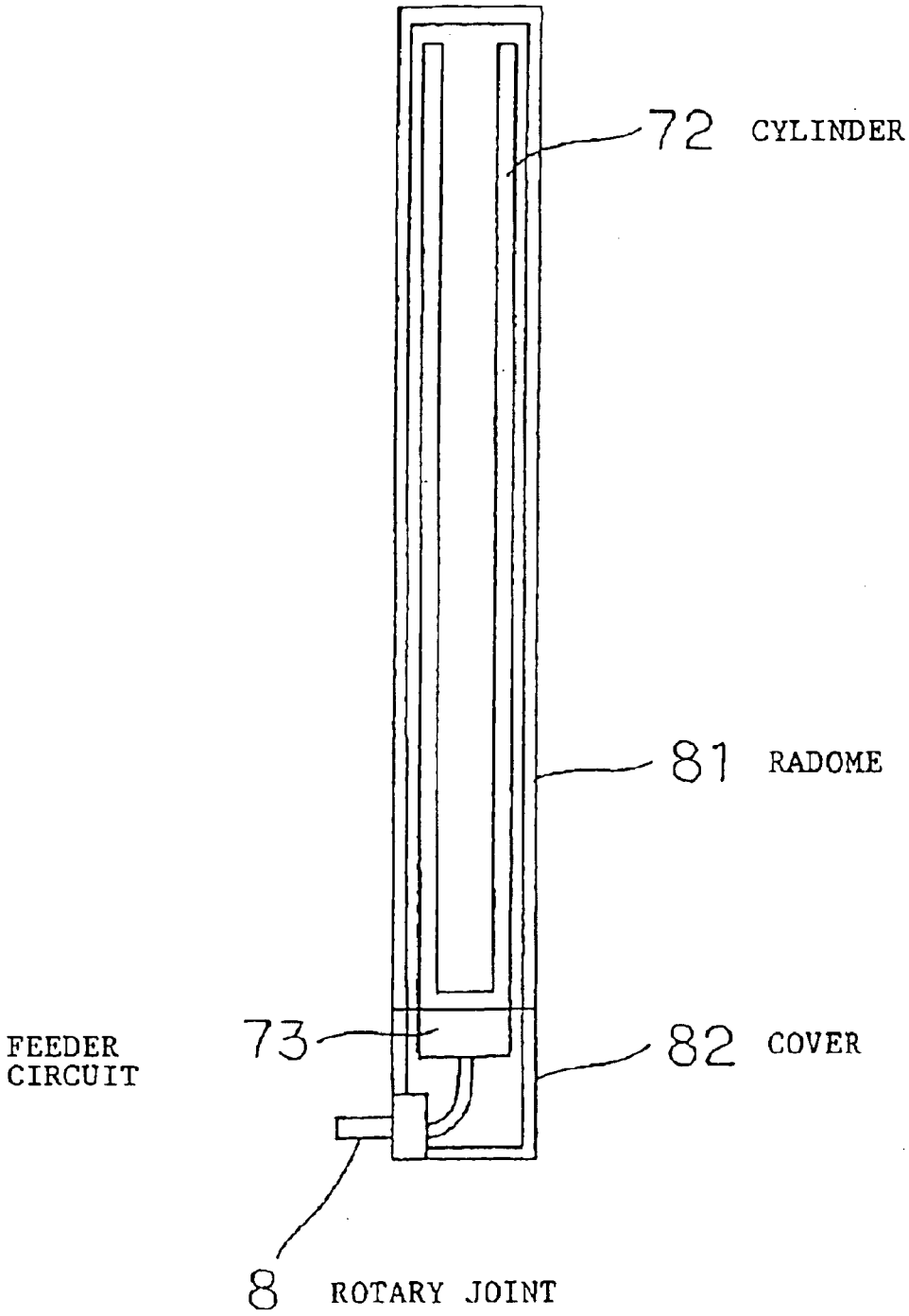
Fig. 2 (PRIOR ART)
FIG. 2 is a cross-sectional view showing a structure of the four-wire helical antenna.
Figure 3:
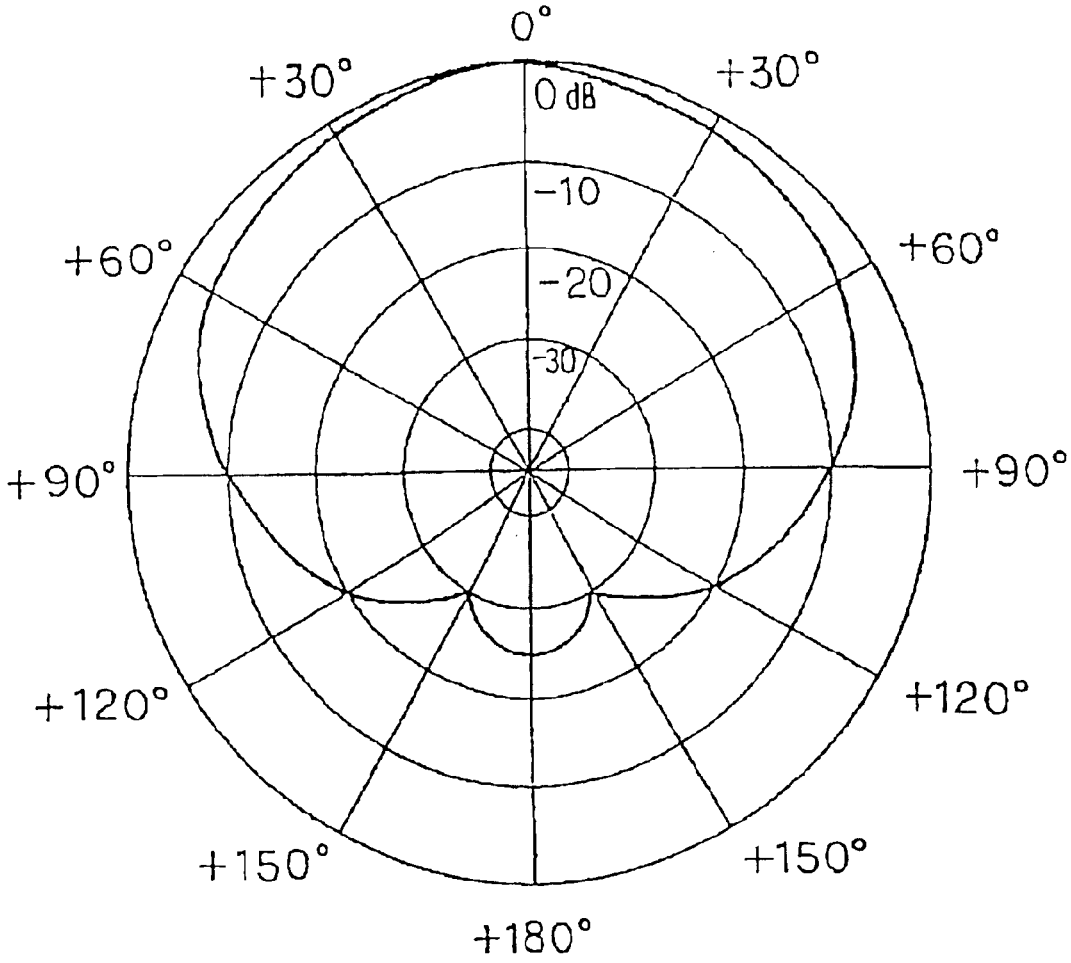
Fig. 3 (PRIOR ART)
FIG. 3 is a diagram showing a directivity pattern of the four-wire helical antenna.

It is ideal that satellite communication antenna 7 has a radiation pattern as shown in FIG. 3 and be used with its tip end facing the zenith. When the antenna is directed and folded and held downwardly, the beam of the antenna is oriented downwardly, and it becomes difficult for the antenna to receive the radio wave from the satellite. According to the present invention, as shown in FIG. 7, the radio wave radiated from antenna 7 whose tip end is directed downwardly is reflected upwardly by reflecting plate 9, and the radio wave from the satellite is reflected by reflecting plate 9 and received by antenna 7 which is oriented downwardly.

The reflecting plate is highly effective from the standpoint of an antenna noise temperature. Specifically, the antenna noise temperature when the antenna is folded to waiting in a reception mode in satellite communications is smaller the better. If antenna 7 with the directivity shown in FIG. 3 is directed toward the ground (downwardly), then antenna 7 directly picks up thermal noise from the ground, and its noise temperature is extremely degraded. However, since reflecting plate 9 blocks a considerable proportion of the thermal noise from the ground, reflecting plate 9 is effective to prevent the noise temperature of antenna 7 from being degraded.

Figure 8:
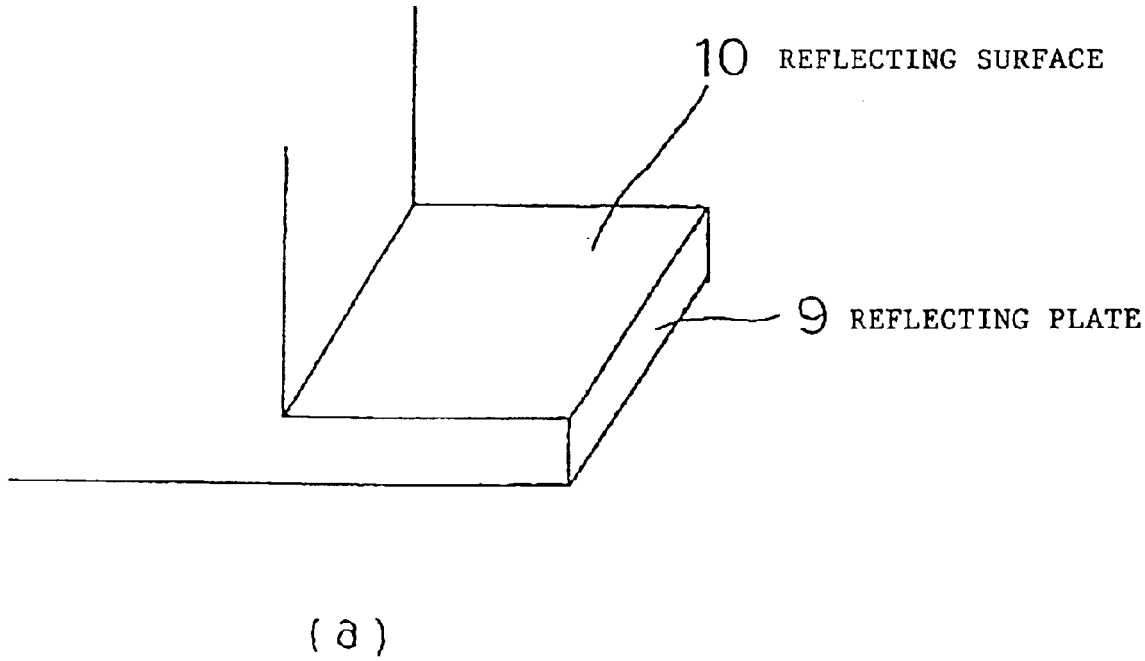
FIGS. 8(*a*) and 8(*b*) are perspective views showing shapes of the reflecting plate.
Figure 8:
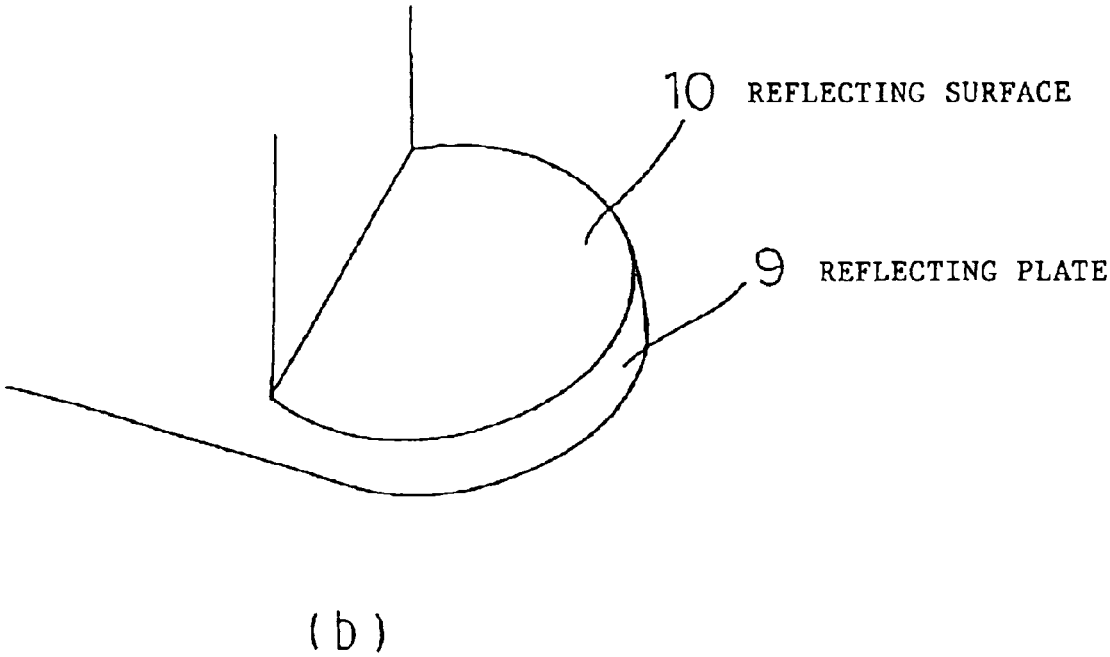

FIGS. 8(*a*) and 8(*b*) show shapes of reflecting plate 9. FIG. 8(*a*) shows a rectangular shape, and FIG. 8(*b*) shows a semicircular shape. Because reflecting plate 9 serves the purpose of reflecting radio waves, reflecting plate 9 needs to be made of a conductor or at least reflecting surface 10 needs to be made of a conductor. At any rate, the wider the surface 10 of reflecting plate 9 is, the greater the effectiveness to raise the receiving level. However, reflecting plate 9 is effective if the diameter of semicircular reflecting plate 9 or one side of rectangular reflecting plate 9 is about 0.1 wavelength (about 2 cm at 1.6 GHz) or more long.

Figure 9:
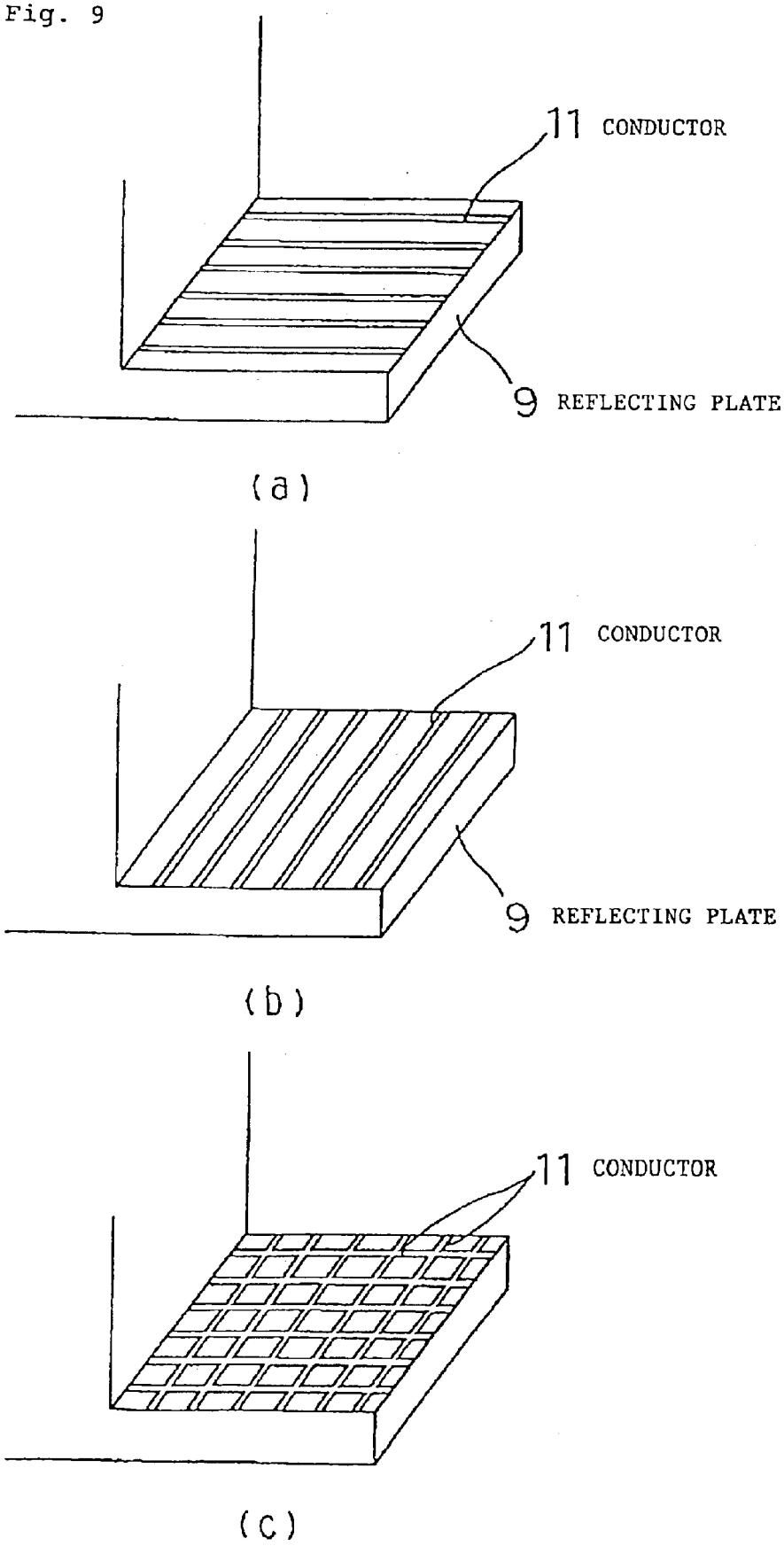
FIGS. 9(*a*), 9(*b*), and 9(*c*) are perspective views showing reflecting plates with reflecting conductors disposed on reflecting surfaces thereof.

Reflecting surface 10 of the conductor may be replaced with a reflecting conductor on the surface of a dielectric material, as shown in FIGS. 9(*a*)–9(*b*). In FIG. 9(*a*), a plurality of conductors 11 each having a certain width are disposed only transversely, and are effective to reflect only an electric field component parallel to conductors 11. In FIGS. 9(*b*) and 9(*c*), reflecting plates have longitudinal conductors 11 and grid-like conductors 11, respectively.

Industrial Applicability

As described above, the terminal device with the small-size reflecting plate in the shape of a saucer being disposed below the rod-shaped antenna folded and held downwardly in facing relation to the tip end of the antenna is capable of waiting for calls from the satellite while the rod-shaped antenna is in the state of on-hook. Therefore, the terminal device can easily wait for calls while it is in moving. The terminal device can also easily wait for radio waves propagating through the air in addition to radio waves from the satellite.

What is claimed is:

1. A portable terminal device having a rod-shaped antenna held upwardly in use for communications and folded downwardly when in a state of on-hook, comprising:

a reflecting plate disposed below said rod-shaped antenna when said antenna is folded downwardly in state of on-hook, said reflecting plate extending across an extension of a longitudinal axis of said folded antenna facing a tip end of said folded antenna.

2. A portable terminal device according to claim 1, wherein said rod-shaped antenna comprises a satellite communication antenna having a directivity for radiating a uniform radio wave to the direction above semispherical surface from the terminal.

3. A portable terminal device according to claim 2, wherein said reflecting plate is rectangular or semicircular in shape when viewed from above.

4. A portable terminal device according to claim 1, wherein said reflecting plate has a reflecting surface made of a conductor.

5. A portable terminal device according to claim 4, wherein said reflecting plate has a reflecting surface having a diameter or a side whose size is 0.1 times a wavelength in use.

6. A portable terminal device according to claim 1, wherein said reflecting plate has a reflecting surface comprising a linear conductor disposed on a surface of a dielectric material.

7. A portable terminal device according to claim 6, wherein said reflecting plate has a reflecting surface having a diameter or a side whose size is 0.1 times a wavelength in use.

8. A portable terminal device according to claim 1, wherein said reflecting plate has a reflecting surface having a diameter or a side whose size is 0.1 times a wavelength in use.

9. A portable terminal device having a rod-shaped antenna held upwardly in use for communications and folded downwardly when in a state of on-hook, comprising:

a reflecting plate disposed below said rod-shaped antenna and facing a tip end of said folded antenna when said antenna is folded downwardly, wherein said rod-shaped antenna comprises a satellite communication antenna, wherein said reflecting plate projects horizontally from a housing of the portable terminal device and below said antenna.

10. A portable terminal device according to claim 9, wherein said reflecting plate is rectangular or semicircular in shape when viewed from above.

11. A portable terminal device according to claim 10, wherein said reflecting plate has a reflecting surface made of a conductor.

12. A portable terminal device according to claim 10, wherein said reflecting plate has a reflecting surface comprising a linear conductor disposed on a surface of a dielectric material.

13. A portable terminal device according to claim 9, wherein said reflecting plate has a reflecting surface having a diameter or a side whose size is at most 0.1 times a wavelength in use.

* * * * *